United States Patent [19]

Tengzelius et al.

[11] Patent Number: 4,518,427

[45] Date of Patent: May 21, 1985

[54] IRON OR STEEL POWDER, A PROCESS FOR ITS MANUFACTURE AND PRESS-SINTERED PRODUCTS MADE THEREFROM

[75] Inventors: Jan R. Tengzelius, Viken; Carl-Axel Blände; Lars-Erik Svensson, both of Höganäs, all of Sweden

[73] Assignee: Höganäs AB, Höganäs, Sweden

[21] Appl. No.: 436,798

[22] Filed: Oct. 26, 1982

[30] Foreign Application Priority Data

Nov. 11, 1981 [SE] Sweden ..... 8106711

[51] Int. Cl.[3] ..... B22F 1/00

[52] U.S. Cl. ..... 75/251

[58] Field of Search ..... 148/423, 35; 75/251, 75/255

[56] References Cited

U.S. PATENT DOCUMENTS 3,698,877 10/1972 Motoyoshi ..... 75/255

OTHER PUBLICATIONS

Bu Vens, D. K.; *Steel and its Heat Treatment*, vol. III, 5th edition; J. Wiley & Sons; pp. 455, 456, 486–488; TS320B9 (1949).

*Primary Examiner*—W. Stallard

*Attorney, Agent, or Firm*—Burns, Doane, Swecker and Mathis

[57] ABSTRACT

Chromium-containing iron or steel powder containing about 0.2–15 percent by weight of chromium, the rest being iron. The powder is characterized thereby that the chromium is present in the form of a powder-formed Fe-Cr-alloy in α-phase containing about 40–50 percent by weight of chromium and having a particle size essentially less than about 50 μm; a process for manufacturing the powder and pressed and sintered products manufactured in a powder-metallurgical manner starting from the said powder.

4 Claims, 1 Drawing Figure

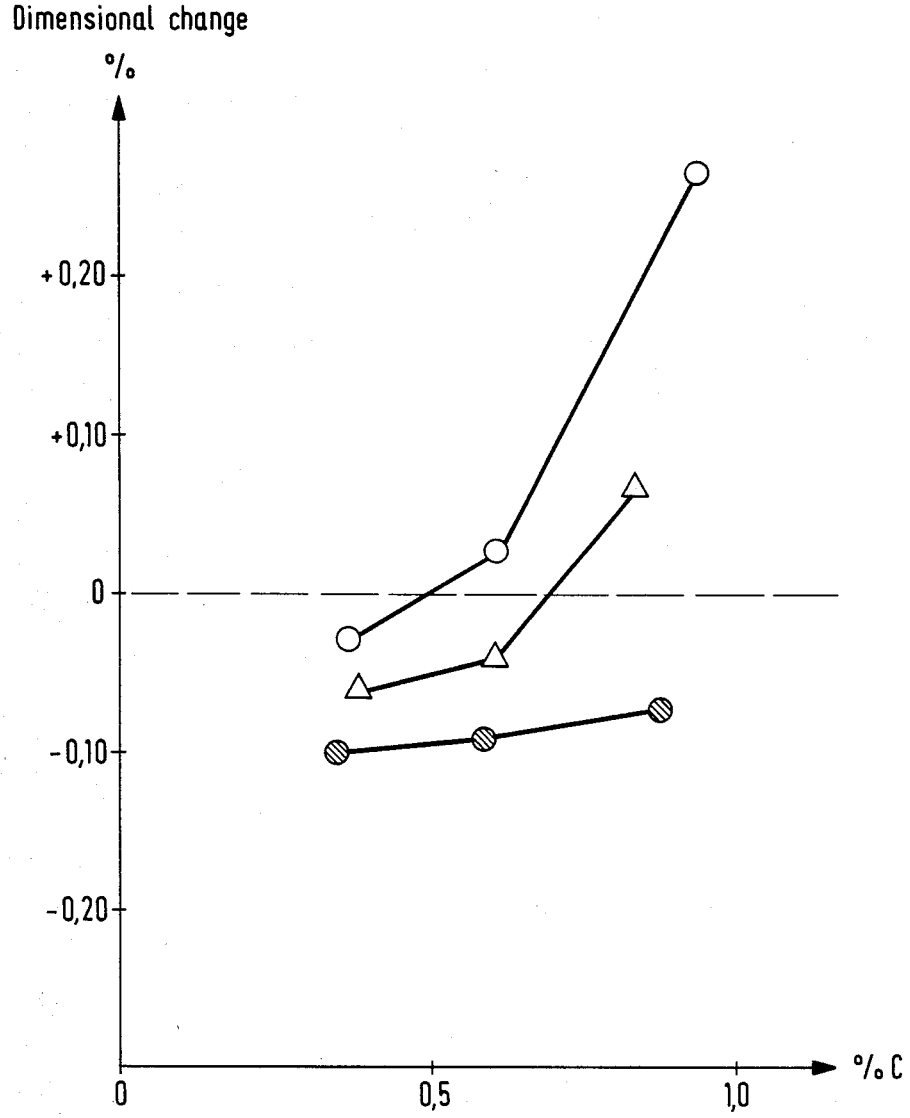
○ σ - phase of particle size > 44 μm
⊘ σ - phase of particle size < 15 μm
△ σ - phase of particle size < 15 μm annealed at 950 °C

IRON OR STEEL POWDER, A PROCESS FOR ITS MANUFACTURE AND PRESS-SINTERED PRODUCTS MADE THEREFROM

The present invention relates to powder mixtures based on iron powder and containing the alloying element chromium, and a process for their manufacture. Powder mixtures according to the present invention make it possible considerably to increase the use of chromium as an alloying element in powder-metallurgical manufacture of precision components having high strength.

In order to impart to the components made by the powder-metallurgical technique the strength which is frequently required, alloyed powders are used as starting materials. Presently there are used essentially two types of such alloying powders, namely powder mixtures and so-called atomized pre-alloyed powders.

Powder mixtures are prepared by mixing the alloying substance into a powder, either in elementary form, in the form of an alloy containing the alloying element or as a constituent of the iron powder which is decomposable during the sintering process. The atomized steel powders are manufactured by comminuting a steel melt containing the desired alloying elements to a powder. The pre-alloyed atomized powder has, however, the drawback that its compressibility will be relatively low depending on the solution-hardening effect the alloying elements have on each powder particle. High compressibility is, however, essential when a part of high density is desired which is necessary to obtain a high strength. The compressibility for a powder mixture on the other hand is almost the same as that of the iron powder involved. This in addition to the flexibility of the alloying composition characterizing the powder mixture has made the same to be the most frequently used form of alloying powder.

Metal powder mixtures containing the alloying element chromium are known in the powder-metallurgical industry but up to now they have not gained success on the market in spite of the good strength properties that can be obtained with sintered products prepared from such powders. The reason for this lies in phenomena associated with the technique for the manufacture of sintered parts, namely pressing and sintering of shaped bodies of the powder in question. In the following there will be described the phenomena which are of a fundamental importance for a practical and economical manufacture of sintered parts having high strength.

One of the requirements put on a powder for the present purpose is, as previously indicated, that of high compressibility of the powder. Another requirement is that the powder shall not contain alloying particles of such high hardness as to result in an abnormal tool wear in the pressing operation. From experience it is known that powder-formed alloying additives of a hardness exceeding a Vickers hardness of about 1000 units as measured at 10 g load results in a very high tool wear. In order to keep the wear at a reasonable level one therefore wants to use alloying elements having a Vickers hardness below 400 units as measured at a 10 g load.

Another requirement put on the alloying element is that it shall be capable of attaining a fine particle size. The reason for this is the fact that when using a fine particle size there would be obtained a better distribution of the alloying element in the powder mixture which in turn results in better distribution in the pressed shaped body. In the subsequent sintering there will be obtained a more homogeneous structure in view of the shortened diffusion paths. The use of an alloying element of coarse particle size not resulting in a molten phase during the sintering process results in a situation where the alloying particles do not have time to diffuse out into the material with acceptable sintering times but can be observed as more or less separate islands in the sintered structure. This in turn results in the non-obtainment of the strength-increasing effect expected from the alloying element.

When manufacturing powder mixtures containing the alloying element chromium essentially six different methods of adding chromium can be extracted from the powder-metallurgical literature. The characterizing features of these different processes are the following:

One process is the so-called pre-alloying process, i.e. an iron-chromium smelt is comminuted to a powder by atomization. The powder hereby produced is pressed to parts which are then sintered. The disadvantage of this type of powder is, as previously mentioned, the low compressibility of such powder.

Another method of preparing iron powder mixtures containing chromium is to admix a pure chromium powder with an iron powder to the desired chromium content. Since the pure chromium powder shows a micro hardness of about 200–400 Vickers units it does not result in any increased tool wear. However, the disadvantage resides in the fact that due to the low hardness of the chromium powder it is very difficult to comminute same to a fine particle size if an acceptable economy is required.

A third method is to add chromium in the form of an alloy of iron and chromium, for example ferrochromium sur affiné (i.e. a ferrochromium having up to 0.1 percent by weight of carbon). The disadvantage of using such alloy is that it is not capable of comminution to the desired fine particle size since also this powder has a low hardness.

The fourth process described in the literature resides in using chromium in the form of $\sigma$-phase, i.e. an Fe-Cr-alloy having about 40–50% Cr. The $\sigma$-phase is characterized by being very hard, about 2000 units Vickers, and is therefore easily ground to a powder of a fine particle size. In practice it has, however, been found that the use of $\sigma$-phase as a chromium carrier when preparing sintered chromium-alloyed sintered steels results in a tool wear which is not acceptable in the production of long series of precision parts.

A fifth method is to add chromium in the form of ferrochromium carburé (i.e. a ferrochromium having 4 to 7 percent by weight of carbon). This iron-chromium alloy has, as has the $\sigma$-phase, a very high hardness and is capable of grinding to a powder of fine particle size. In practice it has, however, been found, as is the case with $\sigma$-phase, that the tool wear cannot be maintained at an acceptable level.

A sixth method of adding chromium to powder mixture is described in Swedish patent specification 70-16925-5. The method is characterized thereby that an iron-chromium alloy having a chromium content of 35–55% and a particle size of less than 150 $\mu$m is annealed with exclusion of air for 2 hours at 850°–950° C., the alloy obtaining a lower hardness, the annealed powder being then by admixture of iron powder having a particle size of less than 400 $\mu$m adjusted to the desired chromium content. The disadvantage of this process is, however, the coarse particle size shown by the iron-chromium alloy, less than 150 μm. For reasons given above this coarse particle size will influence the properties of the sintered material. According to another embodiment a pulverulent iron-chromium alloy having a chromium content of 35–50% and a particle size of less then 150 μm is admixed with a fine iron powder having a particle size of less than 40 μm, the the mixture being then annealed at 850°–950° C. for a period of time of 2 hours, whereafter the powder is finely divided and optionally adjusted to the desired final chromium content using iron powder.

The drawbacks of this process are several. First, the fine iron powder will contribute to an increased degree of agglomeration during annealing. Since the iron-chromium powder has been possibly softened during annealing the powder mixture will after annealing consist of soft agglomerates which, in accordance to what has been earlier stated, are difficult to grind to a fine particle size in turn resulting in the drawbacks already mentioned.

The problem underlying the invention has thus been to find a way of preparing a powder mixture based on iron powder containing the alloying element chromium, wherein chromium is present in such an extent that the tool wear in pressing will be small and the distribution of chromium in the powder mixture is homogeneous.

The solution to this problem has, in accordance with the present invention, been found to lie therein that an iron-chromium alloy having a chromium content of 40–50 percent by weight in sigma phase (σ-phase) is ground to a powder of fine particle size, said powder being then admixed with an iron powder having a particle size which is substantially greater than that of the σ-phase powder to the desired chromium content and the powder mixture obtained being finally annealed under such conditions that the hard σ-phase will be transformed to α-phase which has a considerably lower hardness than the σ-phase, namely about 300–400 Vickers units as measured at 10 g load. When grinding the powder cake formed during annealing it has been surprisingly found, in spite of the great difference in particle size between the chromium-carrying powder and the iron powder, that the fine particle size that the ground σ-phase powder had remains in the powder transformed to α-phase. The chromium alloyed powder mixture prepared according to the invention thus shows the unique combination of containing the chromium in powder form with fine particle size and low hardness.

The invention also relates to the new chromium-containing iron or steel powder comprising a mixture of iron powder and a chromium-containing powder and containing about 0.2–15 percent by weight of chromium, the chromium being present in the form of a powder-formed Fe-Cr-alloy in α-phase containing about 40–50 percent by weight of chromium having a particle size predominantly less than about 50 μm. The invention also relates to pressed and sintered products prepared in a powder-metallurgical manner starting from such iron or steel powder.

Before admixing with the iron powder and annealing the iron-chromium alloy in σ-phase is thus ground to a fine powder the particle size of which is essentially less than about 50 μm. In particular, the particle size is such that the ground powder can pass a 325 mesh Tyler sieve corresponding to a particle size of less than about 44 μm. Particularly preferred is a particle size essentially less than about 15 μm.

The preparation of the chromium-containing steel powder according to the present invention may suitably be performed in the following manner: An iron-chromium material in σ-phase having a Cr-content of about 40–50% is ground in any known mechanical grinding equipment to a particle size essentially less than about 44 μm (325 Tyler mesh), preferably less than about 15 μm. The ground σ-phase powder is then admixed with an iron or steel powder the particle size of which is essentially greater than about 50 μm and is about 400 μm at a maximum, preferably about 175 μm, to a total chromium-content of about 0.2–about 15%, the powder mixture being then subjected to an annealing operation at about 830°–1150° C., preferably about 875°–975° C., for a period of time of about 10 minutes to about 5 hours, preferably ¼–1 hour in a non-oxidizing atmosphere. The annealed powder mixture is then ground to a powder having a particle size essentially less than about 400 μm, preferably at most about 175 μm.

The chromium-alloyed iron powder is then optionally admixed with pure iron powder to adjust the mixture to the desired chromium content. When the powder is used in powder-metallurgical applications it is suitable to furthermore admix 0–2%, preferably 0–1% of graphite, 0–2%, preferably 0–1% solid lubricant in powder form and each per se or in combination 0–5% nickel, 0–10% copper, 0–5% molybdenium, 0–1.5% phosphorus, 0–5% manganese.

BRIEF DESCRIPTION OF THE DRAWING

The FIGURE illustrates dimensional change data for tensile bars during sintering as discussed in detail hereafter. The significant influence of the particle size of the chromium-carrying powder on dimensional stability is illustrated.

The invention will in the following be further described by non-limiting examples, wherein experiments performed and results obtained therefrom are presented. All through the present disclosure the percentage data given refer to weight if not otherwise stated.

EXAMPLE 1

An iron-chromium material having a chromium content of 46% in σ-phase with a hardness according to Vickers exceeding 2000 units as measured by a load of 10 g is ground to a powder having a particle size essentially less than 15 μm. The powder is then admixed with iron powder having a particle size essentially less than 175 μm to different chromium contents according to the table below. The particle size distribution of the iron powder is within the following ranges:

| | |
|---|---|
| >175 μm | 0–10 |
| >150 μm | 1–15 |
| >100 μm | 10–30 |
| >75 μm | 25–35 |
| >45 μm | 15–40 |
| <45 μm | 20–30% |

TABLE

| | |
|---|---|
| Material A | 1 percent by weight of chromium |
| Material B | 6 percent by weight of chromium |
| Material C | 15 percent by weight of chromium |
| Material D | 20 percent by weight of chromium |
| Material E | Pure α-phase powder |

Materials A–E were then annealed in 15 or 60 minutes at three different temperatures in a non-oxidizing atmosphere. The cake hereby formed was crushed to a powder having a maximum particle size less than 175 μm in regard to materials A–D. Material E, however, was further ground in an attempt to reduce the particle size to the original one, i.e. essentially less than 15 μm. This, however, did not succeed in view of the grinding problems that elements of low hardness give raise to.

After the above treatment the powders of materials B and E were investigated metallographically with regard to the microhardness of the chromium-carrying powder, the following results being obtained.

| Material | Annealing temp. °C. | Annealing time Min. | Microhardness Vickers (10 g) |
|---|---|---|---|
| B | 830 | 15 | 2000 |
| | | 60 | 1500 |
| | 950 | 15 | 360 |
| | | 60 | 230 |
| | 1150 | 15 | 240 |
| | | 60 | 230 |
| E | 830 | 15 | 2000 |
| | | 60 | 1500 |
| | 950 | 15 | 350 |
| | | 60 | 240 |
| | 1150 | 15 | 230 |
| | | 60 | 230 |

The result shows that the chromium-carrying powder after annealing at 830° C. has a very high microhardness which from a technical point of view will give quite a high tool wear in pressing. Annealing at 950° C. has, however, resulted in lowering of the hardness of the chromium-carrying powder to a level which by experience from powder-metallurgical industry is known not to raise any abnormal tool wear. At the higher annealing temperature 1150° C. the hardness has been further decreased. At this annealing temperature a considerably greater grinding energy will, however, be required, which has effected the physical properties of the powder.

The cause of the resulting lower microhardness of the chromium-carrying powder relates to the phase transformation that takes place during annealing when the very hard and brittle σ-phase is transformed to the soft α-phase.

In the metallographic investigation also the different powders of materials A–E were studied with regard to the degree of agglomeration of the chromium-carrying powder. The results hereby obtained showed that material E annealed at 950° and 1150° C., respectively, had agglomerated to a cake which when ground was not capable of grinding to a particle size lower than 44 μm depending on the difficulties mentioned above concerning grinding of materials of low hardness. Thus, it is not possible to obtain soft chromium-carrying powder of a fine particle size starting from pure σ-phase which has been ground to a fine particle size before the phase transformation.

The same investigation on powders of compositions according to A and B shows that no agglomeration of the chromium-carrying powder particles had been obtained but that the α-phase formed during annealing was found in powder form of a fine particle size.

The powders having the compositions according to C and D show a somewhat different picture. The powders of composition C thus show that agglomeration of the σ-phase particles has taken place during annealing, in view of which the α-phase particles obtained on annealing no longer show a particle size essentially less than 15 μm. The size obtained is, however, such that it can be accepted since it does not result in any noticeable negative effect on the sintering properties. Powder of composition D shows a coarser particle size of the α-phase than does C. This coarse particle size cannot be accepted in accordance with the previously given description of the importance of particle size.

The present example thus shows that there exists a temperature and composition range within which a finely ground iron-chromium powder in σ-phase can be softened at the same time as maintaining the original particle size of the σ-phase during annealing to α-phase.

EXAMPLE 2

Three powder mixtures, F, G and H, are prepared. The composition is given in the following data:

Mixture F: 1.5% Cr in σ-phase having a particle size exceeding 44 μm. The rest is iron sponge powder having a maximum particle size of 175 μm.

Mixture G: 1.5% Cr in σ-phase having a particle size less than 15 μm. The rest is iron sponge powder having a maximum particle size of 175 μm.

Mixture H: 1.5% Cr in α-phase prepared of σ-phase, ground to a particle sixe below 15 μm and then annealed at 950° C. in non-oxidizing atmosphere for the purpose of converting the σ-phase to α-phase. After grinding the α-phase shows a particle size exceeding 44 μm. The rest is iron sponge powder having a maximum particle size of 175 μm.

In all mixtures there were then admixed different contents of graphite in the range 0.4–1.0% and 0.5% zinc stearate as a lubricant.

Tensile test bars were then pressed from the mixtures obtained at a pressure of 589 MPa. The tensile test bars were sintered at 1250° C. for ½ hour in an atmosphere consisting of 95% $N_2$ and 5% $H_2$. The dimensional change of the test rods during sintering was determined and the results are shown in the appended FIGURE. The results show that when the alloying substance having a particle size less than 15 μm was admixed the dimensional change is more or less independent of the carbon content. However, when the admixed alloying element has a particle size exceeding 44 μm there is obtained a strong effect on the dimensional change at increasing carbon content. Thus, the example illustrates the great influence that the particle size of the chromium-carrying powder has on the dimensional stability.

We claim:

1. Chromium-containing iron or steel powder suitable for compressing and sintering to form a substantially homogeneous article having good strength and dimensional stability properties comprising a mixture of iron powder and a chromium-containing powder and containing about 0.2–15% by weight of chromium, the rest being iron with usual accessorial elements, optionally together with other conventional alloying elements of alloyed powders, characterized thereby that the chromium is present in the form of a pulverulent Fe-Cr-alloy in α-phase which contains about 40–50% by weight of Cr and has a particle size essentially lower than about 44 μm.

2. Powder according to claim 1, characterized thereby that its chromium content is about 1–10 percent by weight and that the particle size of the alloy is below about 44 μm.

3. Powder according to claim 1, characterized by further containing up to 0.10% of a binder to prevent demixing.

4. Powder according to claim 1, characterized thereby that its chromium content is about 1–10 percent by weight and that the particle size of the alloy is below about 15 μm.

* * * * *